United States Patent [19]

Bottomley

[11] 4,269,001

[45] May 26, 1981

[54] WORK CLAMPING FIXTURE

[75] Inventor: Herbert G. Bottomley, Skipton, England

[73] Assignee: Landis Lund, Limited, Keighley, England

[21] Appl. No.: 133,714

[22] Filed: Mar. 25, 1980

[51] Int. Cl.[3] ..... B24B 5/42

[52] U.S. Cl. ..... 51/237 CS; 51/105 SP

[58] Field of Search ..... 51/105 R, 105 SP, 237 R, 51/237 CS

[56] References Cited

U.S. PATENT DOCUMENTS

| | | | |
|---|---|---|---|
| 2,384,391 | 9/1945 | Ott | 51/237 CS |
| 3,404,492 | 10/1968 | Fournier | 51/237 CS |
| 3,537,215 | 11/1970 | Metz | 51/237 CS |
| 4,003,721 | 1/1977 | Price | 51/237 CS |

*Primary Examiner*—Harold D. Whitehead

*Attorney, Agent, or Firm*—Spencer T. Smith

[57] ABSTRACT

A workholding fixture for clamping a workpiece for rotation about a selected axis comprising at least one throwblock for receiving a workpiece portion to be clamped, a clamp arm associated with the throwblock including a jaw at one end and a control surface at the other end, means for pivotally supporting the clamp arm intermediate the ends, means for selectively displacing the pivotally supporting means along an arc from a predetermined advanced position to a predetermined retracted position, means for pivotally displacing the clamp arm about the pivotally supporting means including cylinder means having bearing surface means selectively displaceable from a retracted position to an advanced position, the bearing surface means having a selected length to permit engagement with the control surface means as the pivotally supporting means and the bearing surface means are displaced between the advanced and retracted positions, and means for maintaining the bearing and control surfaces in engagement.

3 Claims, 3 Drawing Figures

WORK CLAMPING FIXTURE

The present invention relates to workholding fixtures, and more particularly, to workholding fixtures for holding a workpiece in a cylindrical grinding machine.

Workholding fixtures for cylindrical grinding machines generally include one or a plurality of bearing blocks for receiving cylindrical portions such as bearings of a workpiece. A jaw associated with each bearing block is mounted for pivotal displacement to selectively clamp the bearings within the bearing blocks. Such a workholding fixture is disclosed in U.S. Pat. No. 4,003,721.

Since workpieces are usually automatically loaded into and removed from the workholding fixture, the jaws must be pivotally displaced through a substantial arc to clear a displacement path for the crankshaft.

It is, accordingly, an object of the present invention to provide a workholding fixture wherein a displacement path can be established with very limited displacement of the jaw elements.

Other objects and advantages of the present invention will become apparent from the following portion of this specification and from the accompanying drawings which illustrate, in accordance with the mandate of the patent statutes, a presently preferred embodiment incorporating the principles of the invention.

Referring to the drawings.

Figure 1:
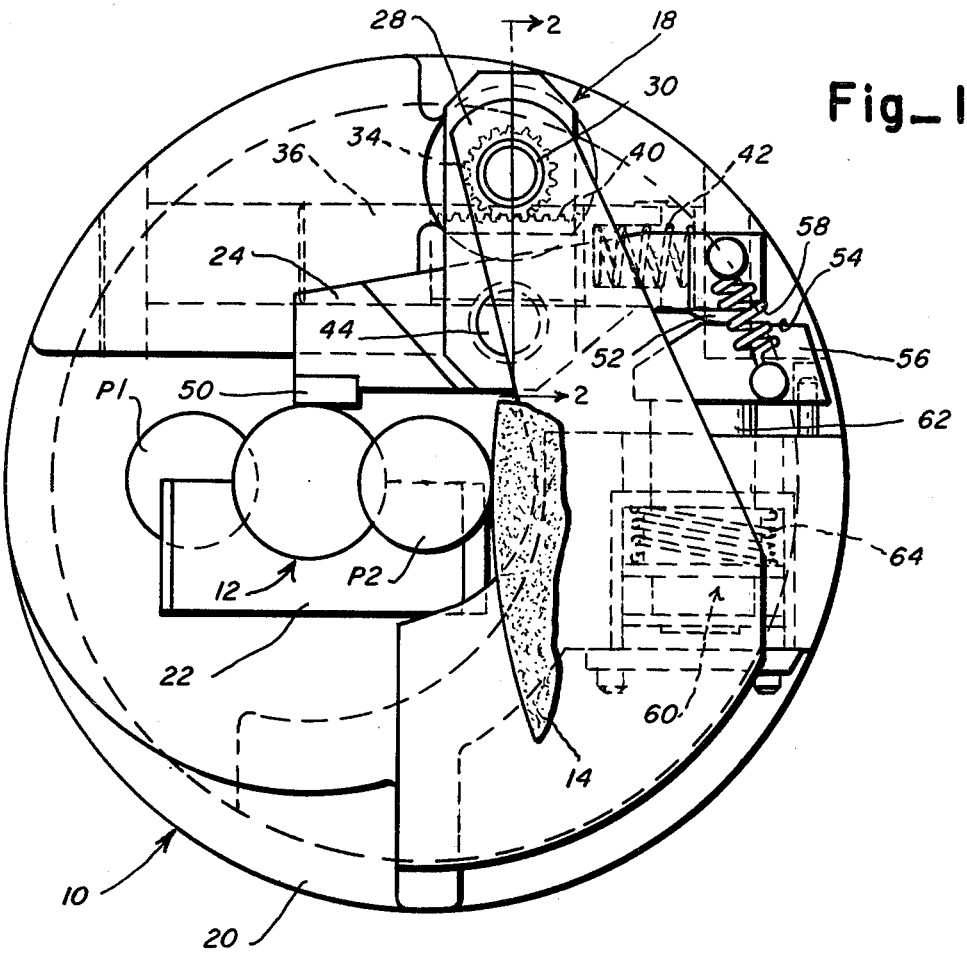
FIG. 1 is an end view of a workholding fixture made in accordance with the teachings of the present invention.
Figure 2:
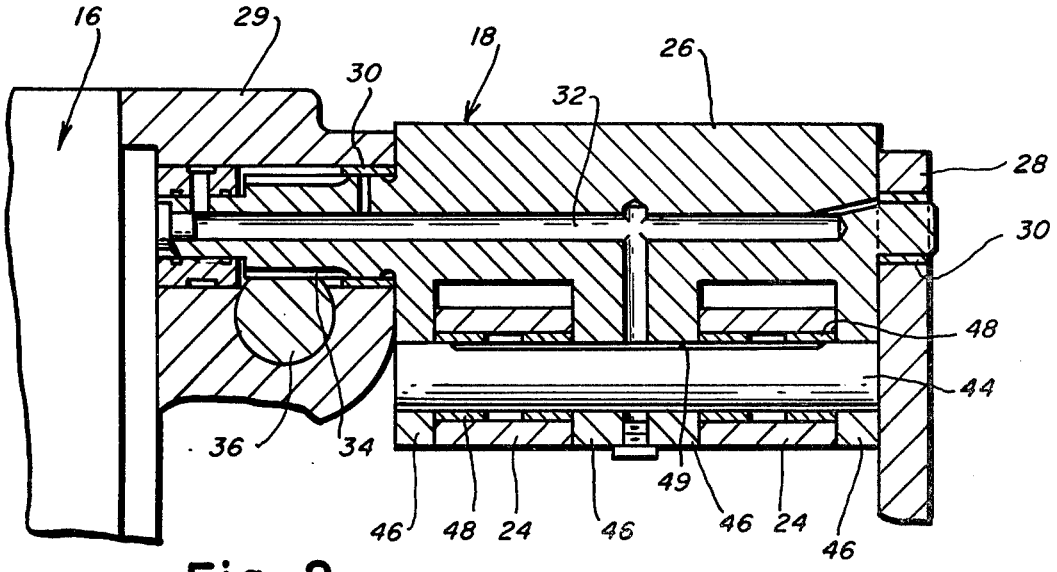
FIG. 2 is a view of the workholding fixture illustrated in FIG. 1 taken along the lines 2—2 thereof.

A cylindrical grinding machine includes one or a pair of workholding fixtures 10 supporting a workpiece for rotation about a predetermined axis of rotation. The illustrated workpiece is a crankshaft 12 for a four cylinder engine having pairs of 180° related crankpins P1, P2, and the work fixture supports one of these pairs so that the axis of rotation of the work fixture is coaxial to the axis of this pin pair. Stock is removed by one or more rotatable grinding wheels 14 selectively advanceable into abrasive engagement with one or both of these crankpins.

The workholding fixture includes a drive plate 16 and a clamping assembly 18 secured to the drive plate, which includes a base 20 supporting two bearing blocks 22 operatively associated with clamp arms 24. A yoke member 26 extends between and is pivotally supported by an upstanding side wall portion 28 of the base and the flange 29. Bushings 30, lubricated by oil supplied through suitable conduits 32, minimize wear. The end of the yoke proximate the drive plate includes a pinion 34. The piston 36 of a yoke control cylinder 38, which is supported by the flange, includes a rack portion 40, which drivingly engages the pinion 34. The piston 36 is biased towards an advanced position by a compression spring 42.

The clamp arms 24 are pivotally supported on a pivot shaft 44 which extends through and is fixedly secured to the downwardly extending legs 46 of the yoke member. Bushings 48, lubricated by oil supplied by suitable conduits 49, minimize wear. Pivotal movement of the yoke member 26, by advancement or retraction of the control cylinder, accordingly, displaces the clamp arm pivot shaft 44 along an arc between retracted and advanced positions. The clamp arms 24 include a hardened workshoe 50 at one end and a bearing surface or button 52 at the other end. The button 52 is maintained in continuous engagement with a bearing surface 54 of a block or piston head 56 by a tension spring 58 extending between the end of the clamp and the block.

The clamp arm control cylinder 60 includes a piston 62 to which the block is secured, which is retained in a retracted position by a heavy compression spring 64. Advancement of the piston 62 pivots the clamp arms 24 counterclockwise about the clamp arm pivot shaft 44.

Figure 3:
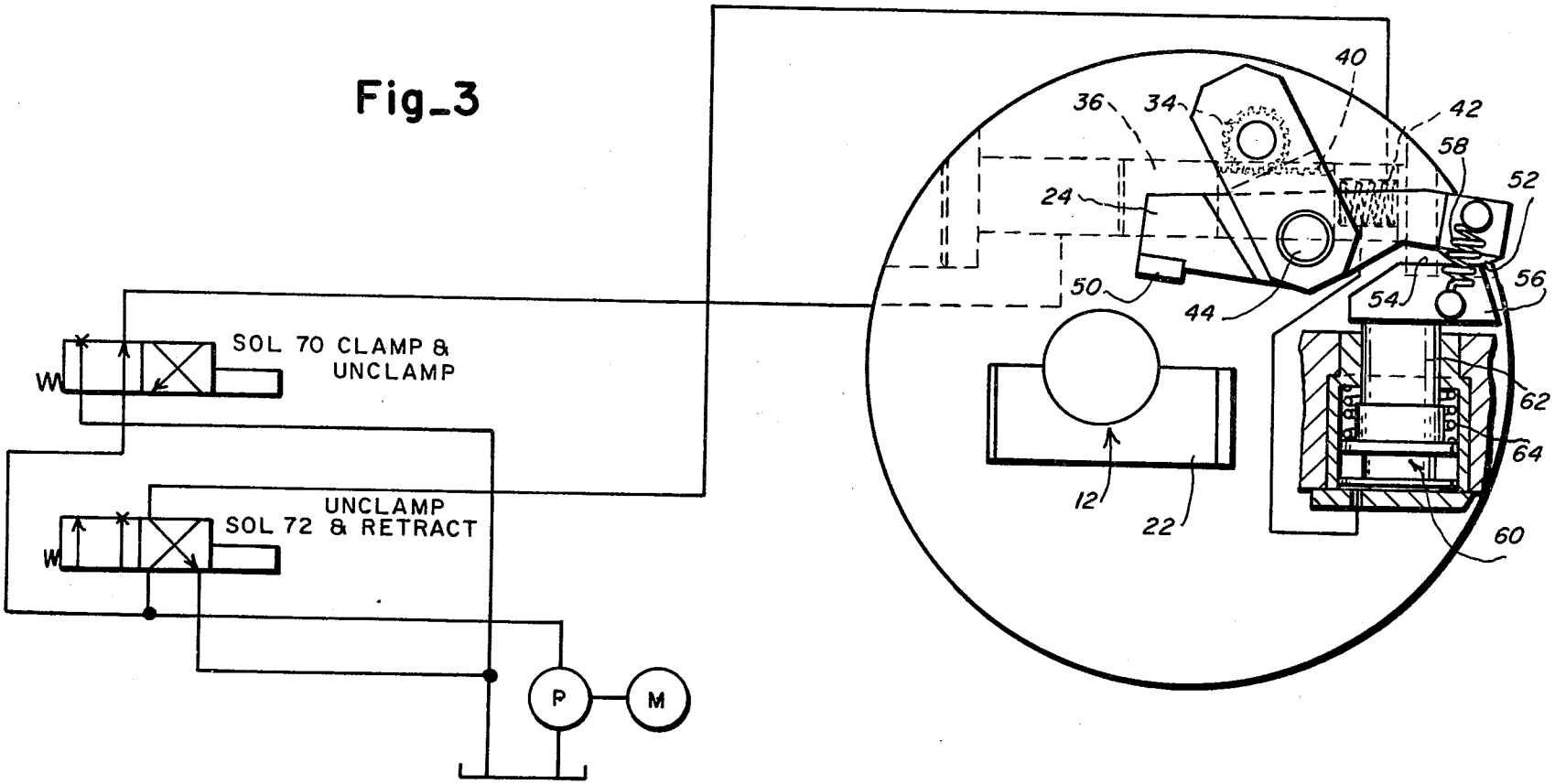
FIG. 3 is a view of a portion of the workholding fixture illustrated in FIG. 1 with the clamping assembly in an unclamped condition with the control circuitry therefor schematically shown.

In the fully retracted condition illustrated in FIG. 3, with the clamp and unclamp solenoid deenergized and the unclamp and retract solenoid energized, the yoke control cylinder is fully retracted and the clamp control cylinder is fully retracted. When these conditions are reversed, the yoke control cylinder piston will be advanced to its fully advanced position whereat a conduit to the clamp control cylinder will be opened. The elevation of this piston to its advanced or elevated position rotates the advanced clamp arm downwardly to clamp the workpiece.

When these conditions are again changed, yoke cylinder spring 42 will momentarily maintain the clamp arms in their advanced position and clamp arm cylinder spring 64 will retract the clamp arm piston to pivot the clamps slightly away from the workpiece. The pressure will then retract the yoke member cylinder and, hence, the clamp arm to the retracted position.

What is claimed is:

1. A workholding fixture for clamping a workpiece for rotation about a selected axis comprising:

at least one throwblock for receiving a workpiece portion to be clamped, a clamp arm associated with said throwblock including a jaw at one end and a control surface at the other end, means for pivotally supporting said clamp arm intermediate said ends, means for selectively displacing said pivotally supporting means along an arc from a predetermined advanced position to a predetermined retracted position, means for pivotally displacing said clamp arm about said pivotally supporting means including cylinder means having bearing surface means selectively displaceable from a retracted position to an advanced position, said bearing surface means having a selected length to permit engagement with said control surface means as said pivotally supporting means and said bearing surface means are displaced between said advanced and retracted positions, and means for maintaining said bearing and control surfaces in engagement.

2. A workholding fixture according to claim 1, wherein said pivotally supporting means comprises:

a yoke having a predetermined axis of rotation, pivot shaft means for supporting said clamp arm and for displacement relative to said yoke.

3. A workholding fixture according to claims 1 or 2, wherein said selectively displacing means comprises:

a pinion integral with said yoke, and a cylinder including rack means operatively engaging with said pinion and means for displacing said rack means from a retracted position to an advanced position.

* * * * *